United States Patent [19]

Hoogenboom

[11] Patent Number: 4,974,555

[45] Date of Patent: Dec. 4, 1990

[54] PISTON MOTOR WITH PARALLEL CYLINDERS ARRANGED AROUND THE DRIVING SHAFT

[76] Inventor: Bob Hoogenboom, Prins Clauslaan 4, Badhoevendorp 1171 LD, Netherlands

[21] Appl. No.: 434,582

[22] PCT Filed: May 21, 1987

[86] PCT No.: PCT/NL87/00011

§ 371 Date: Jan. 20, 1988

§ 102(e) Date: Jan. 20, 1988

[87] PCT Pub. No.: WO87/07327

PCT Pub. Date: Dec. 3, 1987

Related U.S. Application Data

[63] Continuation of Ser. No. 163,114, Jan. 20, 1988, abandoned.

[30] Foreign Application Priority Data

May 22, 1986 [NL] Netherlands ..... 8601312

[51] Int. Cl.[5] ..... F02B 75/24

[52] U.S. Cl. ..... 123/56 C; 123/58 A; 123/58 AM

[58] Field of Search ..... 123/50 R, 56 C, 58 A, 123/58 AB, 58 AM, 59 R, 197 R, 58 AA, 56 AC, 56 BC

[56] References Cited

U.S. PATENT DOCUMENTS

| | | | |
|---|---|---|---|
| 1,413,363 | 4/1922 | Smith et al. | 123/58 A |
| 1,529,687 | 3/1925 | Bowen | 123/58 AM |
| 1,788,140 | 1/1931 | Woolson | 123/58 AM |
| 1,808,083 | 6/1931 | Tibbetts | 123/58 AM |
| 1,810,017 | 6/1931 | Houston | 123/58 AA |
| 2,027,076 | 1/1936 | Volliman | 123/58 AB |
| 3,107,541 | 10/1963 | Parsus | 123/58 A |
| 3,687,117 | 8/1972 | Panariti | 123/58 AA |
| 3,942,488 | 3/1976 | Phillips et al. | 123/197 R |
| 4,023,542 | 5/1977 | Ango | 123/58 R |
| 4,129,101 | 12/1978 | Townsend | 123/58 AM |

FOREIGN PATENT DOCUMENTS

| | | | |
|---|---|---|---|
| 1155768 | 10/1983 | Canada | 123/58 A |
| 0153528 | 9/1985 | European Pat. Off. . | |
| 3028201 | 2/1982 | Fed. Rep. of Germany . | |
| 285764 | 5/1931 | Italy | 123/58 AA |
| 8606438 | 11/1986 | PCT Int'l Appl. | 123/58 AM |
| 343942 | 8/1929 | United Kingdom . | |
| 589719 | 6/1947 | United Kingdom | 123/58 AB |

*Primary Examiner*—David A. Okonsky
*Attorney, Agent, or Firm*—Kenyon & Kenyon

[57] ABSTRACT

The invention is embodied in a multi-cylinder internal combustion engine. The cylinders (4) of the engine are arranged parallel about the output shaft (2). Each cylinder (4) has a piston (5) and each piston has a driving rod (6). The driving rods move parallel to the output shaft (2) and engage a common disc (8) secured to the output shaft. The disc (8) is provided with a corrugated surface (9) which is formed of substantially straight surfaces interconnected to each other. The driving rods (6) engage the straight surfaces to thereby control piston motion.

20 Claims, 2 Drawing Sheets

PISTON MOTOR WITH PARALLEL CYLINDERS ARRANGED AROUND THE DRIVING SHAFT

This application is a continuation of application Ser. No. 07/163,114, filed Jan. 20, 1988, now abandoned.

The invention relates to a piston engine with parallel cylinders arranged around the driving shaft.

Engines (and pumps) with a so-called tumbling disc are known, in which the longitudinal axis of each cylinder is directed substantially parallel to the driving shaft, and the free extremity of the piston rod of each cylinder engages a surface portion of a disc mounted on such a shaft, such a surface portion including such an angle with said shaft that a reciprocating movement of a piston rod is transformed into a rotating movement of said disc and vice versa.

In such an engine the crank shaft of the normal piston engines having a plurallity of cranks and, as the case may be, a plurallity of bearings, is replaced by the tumbling disc which, in fact, serves as a single crank for all the piston rods, which may lead to a more favourable force distribution, and the above-mentioned structure of such an engine can provide a better space utilization.

Manufacturing such a tumbling disc arranged at the correct angle on the shaft is not simple, and, furthermore, its operation has, with respect to the length of the piston strokes and the piston velocity, must, in each stroke completely correspond with the operation of a crank-shaft engine.

It is an object of the invention to provide an engine of this kind in which the piston movement in each stroke can be fully adapted to the operation desired in that stroke.

To that end the engine according the invention is characterized in that the disc is directed transversely to the shaft, its lateral surface directed to the cilinders being provided with a corrugated surface portion engaged by the extremity of each piston rod, and in that the corrugated surface portion is shaped in such a matter that during each piston stroke the stroke length and/or the piston velocity are adapted to the operation to be performed during the respective stroke.

In particular the reversal joint at the end of the active stroke of a piston can be positioned at a larger distance from the cylinder head than the corresponding point at the end of the suction stroke so that, then, in the vicinity of the former point, an additional exhaust port can be provided in the cylinder wall, by means of which the discharge of the combustion gases can be expedited.

The corrugated surface portion can, in particular, be a separately manufactured part which can consist of a strip which is pressed in the desired shape, and which, if required with the interposition of filling elements, is fixed on the plane disc.

Furthermore the free extremity of each driving rod can be hingedly connected with a guiding arm, which, on the other hand, is hingedly connected with a fixed part of the engine, and, in particular each guiding arm can be provided with a pressure piece contacting the corrugated surface portion of said disc, and, more in particularly, the distance between the fixed hinge point of the guiding arm and the connecting point of the driving rod can be larger than the distance thereof to the pressure piece, and, during the combustion stroke, the pressure piece may assume an orientation which is favourable for the transfer of forces to the corrugated disc portion, and, because of the difference in length of the arms of the lever thus formed, the corrugations can be made less deep for obtaining the same piston displacement.

For obtaining an unambiguous engagement of the driving rod and/or pressure piece, a spring acting thereon can be used.

If required, and for anabling to take up force components directed transversely to the disc in a better way, for each cylinder a supporting means can be provided at the opposite side of said disc, and it is also possible to make said disc symmetrical in respect of the transversal median plane, and to provide, at both sides thereof, cylinders aligned in paris so that the longitudinal component of the forces exerted thereby will be balanced.

The invention will be elucidated below in more detail by reference to a drawing, showing in:

Figure 1:
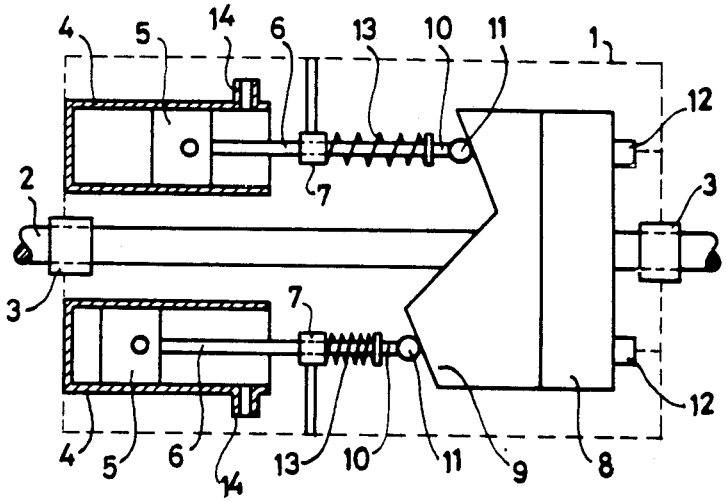
FIG. 1 is a simplified diagrammatical representations of engines according to the invention.

In FIG. 1 the structure of the engine according to the invention is represented in a highly simplified manner.

In an engine housing which is schematically indicated at 1 a shaft 2 is supported in bearings 3. Within said housing a number of cylinders 4 having cooling means, valves and ignition parts of the current type not shown, is arranged, said cylinders being directed substantially parallel to the shaft 1, and being uniformly distributed around the shaft 2, so that a substantially cylindrical and symmetrical structure is obtained.

In the cylinders 4 pistons 5 with driving rods 6 are movable, said driving rods being guided in guides 7. On the shaft 1 a disc 8 is mounted which, at the side directed to the cylinders 4, is provided with a corrugated surface 9 which is engaged by extremities 10 of the driving rod 6, which, if required, may be provided with rollers 11 or the like. At the other side of the disc 8 supporting bearings 12 connected to the housing 1 can be provided which are aligned with de driving rods 6.

It will be clear that, on rotation of the disc 8, the pistons 5 will be reciprocated if the driving rod extremities 10 remain pressed against the surface 9 of the disc 8, which may be enhanced by means of springs 13. Conversely, the forces exerted because of the pressure by combustion in the cylinders 4 on the driving rod 6 will be transfered by means of the rollers 11 and the respective parts of the corrugated surface 9 of the disc 8, the longitudinal component of said forces being taken up by the additional supporting means 12.

Figure 2:
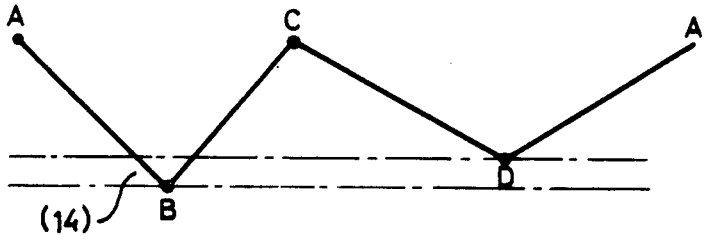
FIG. 2 is a diagrammatical development of the corrugated surface of a part of this engine.

In FIG. 2 a development of an embodiment of the corrugated surface 9 is represented. In the portion AB the force exerted during the combustion on the piston 5 and the driving rod 6 is acting on the disc 8, whereas in the portion BC the piston 5 is pressed backwards and the expansion of the combustion gasses takes place. In the portion CD the cylinder 4 is filled again, and in the portion DA the charge is compressed. The inclinations of the different portions can be mutually different, and can, in particular, be adapted to an optimal operation in the movement portion in question. The inclination is, in the portion AB, rather large and is, for instance, about 45°, in order to obtain a fast expansion of the combustion gases and a favourable force transmission.

In the case of a single wave portion the pistons 5 will make four strokes during one revolution of the disc 8. In comparison with a crank-shaft engine the rotational speed of the disc 8 can be half at the same piston speed and the same number of cylinders. If the different portions of the corrugated surface 9 are straight, the angle at which the force transfer takes place will be constant in any portion, this in contrast to a crank-shaft engine in which the angle between the driving rod and the crank arm continuously changes. If required the portion AB, in which the driving forces are transferred, can be curved so that this force transfer in view of the pressure development during combustion will take place as favourably as possible. In the other portions the shape of the surface of less important, but the inclination is important since it determines the duration of the stroke in question. Thus portion CD in particular can be directed at such a small inclination that the suction stroke has a sufficient duration for obtaining a good charging of the cylinder.

As shown in FIG. 2, the piston stroke in the portion CD is smaller than in the portion AB. The intention thereof is to enable the provision of an additional exhaust port 14 which only at the end of the combustion stroke is liberated by the piston 5, so that, then, a first discharge of the exhaust cases having a residual pressure is obtained, whereas during the stroke BC the rest of the gases is driven by the piston towards the normal discharge valves. If necessary, additional valves can be provided in the exhaust ducts communicating with said port 14, which valves prevent a direct connection with the interior of the housing 1, but these valves can be low-pressure valves which must not satisfy stringent requirements.

Figure 3:
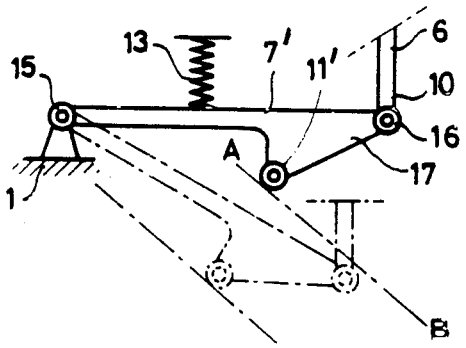
FIG. 3 is a diagrammatical representation of a special guiding arm for a driving rod of such an engine.
Figure 4:
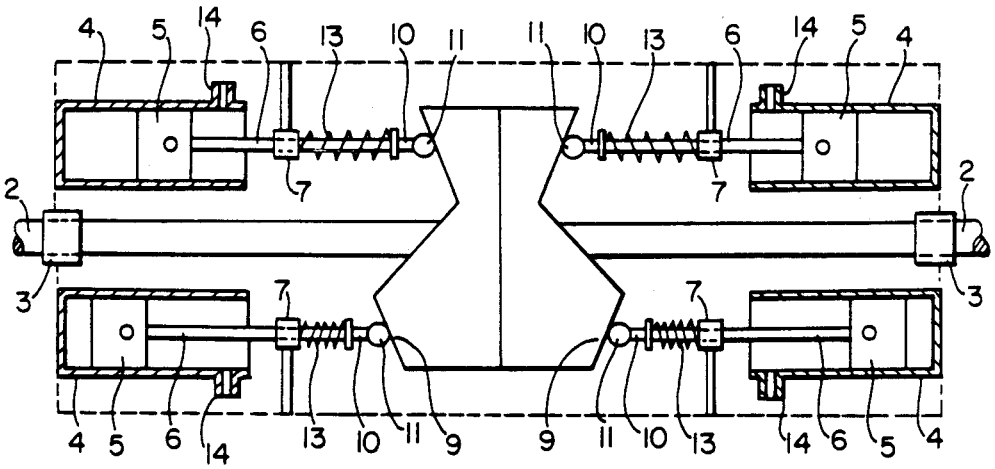
FIGS. 4 and 5 are diagrammatical views of the invention.
Figure 5:
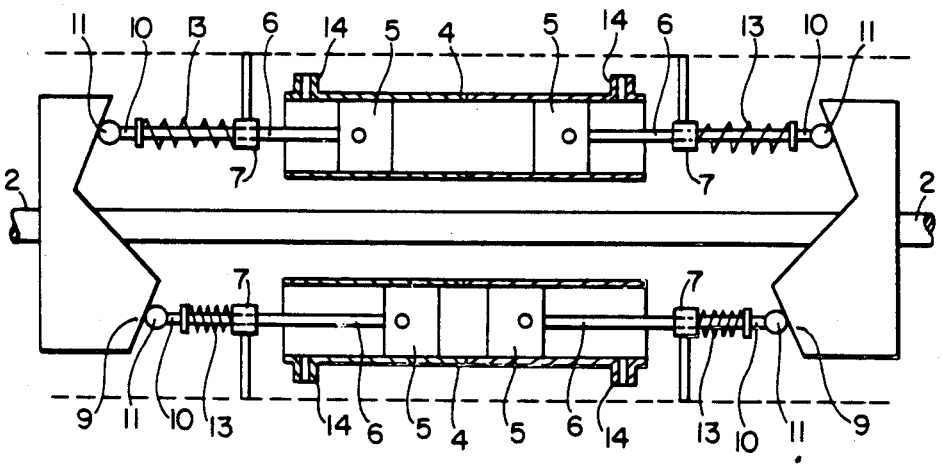

FIG. 3 shows a special embodiment in which the guide 7 for the driving rods 6 are formed by guiding arms 7'. Each guiding arm is, at 15, hingedly connected with the housing 1, and at the other extremity 16 the driving rod 6 in question is hingedly connected.

Furthermore the arm 7' carries a pressure piece 17, contacting by means of a roller 11' or the like the corrugation 9 of the disc 8, and, in the case shown, the portion AB thereof.

By turning the arm 7' it will more closely point in the direction of the surface AB, which may be favourable for the force transfer. If, moreover, the point 16 is at a greater distance from the fulcrum 15 than the point 17, a lever action is obtained allowing to make the corrugation 9 less deep. The return spring 13 can act in a suitable point of the arm 7', which arm can, if required, be made in the form of a bell crank.

The transitions between the different portions of the surface 9 will, moreover, be rounded so that a suitable reversal of the piston movement is obtained. Moreover it is also possible to provide on the disc 8 a corrugation 9 comprising more than one succession of the portions shown in FIG. 2, so that, then, during one revolution a corresponding larger number of piston strokes will be obtained.

Instead of the supporting means 12, adapted to take up, in particular, the longitudinal forces during the combustion stroke, is also possible to construct the disc 8 completely symmetrically and to arrange also at the other side, and aligned with the pistons 4 shown, corresponding pistons, all this in such manner that force components acting transversely on the disc will always balance each other.

Instead of cylinders pairs arranged at both sides of a symmetrical disc 8 having two surfaces 9, in which the pistons always perform their active stroke simultaneously, so that force components acting in the axial direction are balanced at the disc 8, it is also possible to use double-piston cylinders in which both pistons are driven outwards simultameously but in opposite senses, their driving rods each acting on an associated corrugated disc 9, said disc being arranged at both sides of the cylinder assembly. The axial forces acting on the shaft 2 will then be balanced. The bearings 3 will then be relieved. The shaft 2 should then be strengthened accordingly.

The corrugated surface 9 of the disc 8 can be obtained by means by suitably machining the surface of the disc, but this can be objectionable. It is also possible to form this corrugated surface from a separate strip, and to fix the strip, if required, with the interposition of fillers, on the disc 8. This strip should consists of a material which is sufficiently wear-proof and which, in particular, has been subjected to a surface treatment, and the fillers should only be sufficiently pressure resistant so as to counteract deformed of said strip. The corrugated surface 9 can also be obtained, if required together with the disc 8, by casting.

Moreover the disc 8 can be constructed as a flywheel, and additional cam surfaces can be provided thereon for actuating valves and like, and, as the case may be, for returning the driving rod 6 instead of by the springs 13.

In the preceding description reference is be made to four-stroke engines. It will, however, be clear that also a two-stroke engine can be constructed is this manner. In the case of a double-piston engine a favourable charging can be obtained by means of two ports 14 between the pistons, one acting as an exhaust port and the other as the charging port, and, moreover, by means of a suitable flushing pump a favourable discharge of combustion can be obtained. Thus a better charging of the cylinders can be obtained than is possible in de current two-stroke engines. By a suitable construction of the cam surfaces in question it can be obtained that the charge and exhaust ports are closed and opened at the correct moment by the adjacent piston, and, after ignition of the gas mixture, both pistons will move symmetrically in respect of each other. Compared with the known double-piston engines the advantage is obtained that no double crank shaft is required, and that, by a partly asymmetric piston movement, an optimal gas exhaust, flushing and gas supply can be obtained.

In the embodiment shown it can be favourable, moreover, to provide half-way the stroke of the piston an additional suction port providing an additional charging, which can be closed by means of suitable valves.

Moreover it will be clear that the shaft should not necessarily be disposed horizontally, and can be arranged vertically if required.

I claim:

1. A piston engine, comprising a plurality of cylinders, each cylinder having a piston slidable therein, each piston having a driving rod, the longitudinal axis of each piston being at a distance from and parallel to a shaft to be driven, each driving rod being movable substantially parallel to said shaft, and engaging, at its free extremity, a disc connected with said shaft, each driving rod having a compression spring which urges the driving rod free extremity against said disc, said disc having substantially straight surfaces directed at an angle with said shaft and with each other so as to define transition regions at their intersection, said surfaces causing a reciprocation of each driving rod on rotation of said shaft, wherein a lateral surface of the disc is provided with a corrugated surface portion with which the extremity of each driving rod is in engagement, and in that the corrugated surface portion is formed in such a manner that, during each piston stroke, the stroke length and the stroke velocity is adapted to the operation to be performed during the stroke in question.

2. The engine of claim 1, in which each cylinder is provided with two pistons movable in opposite senses, characterized in that the shaft (2) is provided with two discs (8) with corresponding corrugated surfaces (9), said discs being arranged at both sides of the cylinder assembly, and each cooperating with the driving rods (6) of one set of pistons (5).

3. The engine of claim 1 or 2, characterized in that the end of the operative stroke of the pistons marks a reversal point which is situated at the larger distance from a head of the cylinder than the point at the end of the suction stroke, and in that, in the vicinity of the first mentioned reversal point, an exhaust port is provided.

4. The engine of any one of claims 1 or 2, characterized in that the corrugated surface portion (9) is a separately manufactured part, in particular a strip pressed in the desired shape, which, if necessary with interposed filling pieces, is fixed on the flat disc (8).

5. The engine of claim 1 characterized in that the free extremity of each driving rod is hingedly connected with a guiding arm at a connecting point, and in that each said guiding arm is hingedly connected with a fixed portion of the engine at a fixed hinge point.

6. The engine of claim 5, characterized in that each guiding arm (7') is provided with a pressure piece (17) engaging the corrugated surface portion (9) of the disc (8).

7. The engine of claim 6, characterized in that the distance of the fixed hinge point of the guiding arm to the connecting point with the driving rod is larger than the distance from the fixed hinge point to the pressure piece.

8. The engine of any one of claims 1, 2, 5, 6 or 7, characterized in that, for each cylinder (4), at the remote side of the disc (8) a supporting element (12) is provided.

9. The engine of any one of claims 1, 2, 5, 6 or 7, characterized in that the disc is symmetrically constructed with respect of a transverse medium plane, and that, at both sides thereof, cylinders aligned in pairs are arranged.

10. The engine of claim 1, characterized in that the or each cylinder is a double-piston cylinder, a disc (8) being provided at both sides thereof, each disc cooperating with a corresponding piston (5).

11. The engine of claim 10, constructed as a two-stroke engine, characterized in that the corrugated surface portions (9) of the discs (8) are so that the pistons (5), during a part of their movement, are moved relatively to each other in a non-symmetrical manner.

12. A piston engine, comprising a plurality of cylinders having pistons slidable therein, each of said pistons having a driving rod, the longitudinal axis of each piston being at a distance from and parallel to a shaft to be driven, each driving rod being movable in a direction substantially parallel to said shaft, and each driving rod engaging, at a free extremity thereof, a disc connected with said shaft, each driving rod having a compression spring which urges the driving rod free extremity against said disc, said disc having substantially straight surfaces directed at an angle with said shaft and with each other so as to define transition regions at their intersection, said surfaces causing a reciprocation of each driving rod on rotation of said shaft, wherein a lateral surface of the disc is provided with a corrugated surface portion with which the extremity of each driving rod is in engagement, and in that the corrugated surface portion is formed in such a manner that, during each piston stroke, the stroke length and the stroke velocity is adapted to the operation to be performed during the stroke in question and further characterized in that the end of the operative stroke of the pistons is marked by a reversal point which is situated at the larger distance from a head of the cylinder than the point at the end of the suction stroke, and in that, in the vicinity of the first mentioned reversal point, an exhaust port is provided.

13. The engine of claim 1, in which each cylinder is provided with two pistons movable in opposite senses, characterized in that the shaft is provided with two discs with corresponding corrugated surfaces said discs being arranged at both sides of the cylinder assembly, and each cooperating with the driving rods of one set of pistons.

14. The engine of any one of claims 12 or 13 characterized in that the corrugated surface portion is a separately manufactured strip pressed in the desired shape which is fixed on the flat disc.

15. The engine of claim 12 characterized in that the free extremity of each driving rod is hingedly connected with a guiding arm at a connecting point and in that each said guiding arm is hingedly connected with a fixed portion of the engine at a fixed hinge point.

16. The engine of claim 15, characterized in that each guiding arm is provided with a pressure piece engaging the corrugated surface portion of the disc.

17. The engine of claim 16, characterized in that the distance between the fixed hinge point of the guiding arm to the connecting point of the guiding arm with the driving rod is larger than the distance from the fixed hinge point to the pressure piece.

18. The engine of claim 12, characterized in that each cylinder is a double-piston cylinder, a disc being provided at both sides thereof, each disc cooperating with a corresponding piston.

19. The engine of claim 18, constructed as a two-stroke engine, characterized in that the corrugated surface portions of the discs are such that the pistons during a part of their movement, are moved relatively to each other in a non-symmetrical manner.

20. The engine of claim 1 or 2 characterized in that the disc is symmetrically constructed with respect to a transverse medium plane, and that, at both sides thereof, cylinders aligned in pairs are arranged.

* * * * *